United States Patent [19]

Payne

[11] Patent Number: 4,585,421

[45] Date of Patent: Apr. 29, 1986

[54] METHOD OF MAKING COPPER-CLAD BIMETAL ELECTRODES FOR SPARK PLUGS

[75] Inventor: George T. Payne, Tiffin, Ohio

[73] Assignee: The National Machinery Company, Tiffin, Ohio

[21] Appl. No.: 554,561

[22] Filed: Nov. 23, 1983

[51] Int. Cl.[4] ..... H01J 21/02

[52] U.S. Cl. ..... 445/7

[58] Field of Search ..... 445/7, 49; 72/47; 29/874, 877, 878, 879, 882, 885

[56] References Cited

U.S. PATENT DOCUMENTS

| | | | |
|---|---|---|---|
| 2,615,441 | 10/1952 | Bychinsky | 445/7 |
| 2,898,395 | 9/1959 | Schurecht | 445/7 |
| 3,119,944 | 1/1964 | Lentz et al. | 445/7 |
| 3,252,207 | 5/1966 | Gwyn, Jr. | 29/879 |
| 3,857,145 | 12/1974 | Yamaguchi et al. | 445/7 |
| 3,889,366 | 6/1975 | Shibata | 29/887 |
| 4,351,095 | 9/1982 | Davies | 445/7 |
| 4,446,618 | 5/1984 | Bollian | 29/882 |

FOREIGN PATENT DOCUMENTS

| | | | |
|---|---|---|---|
| 216899 | 10/1957 | Australia | 29/874 |
| 0044764 | 1/1982 | European Pat. Off. | 445/7 |
| 2076706 | 12/1981 | United Kingdom | 445/7 |

*Primary Examiner*—Nicholas P. Godici
*Assistant Examiner*—Kurt Rowan
*Attorney, Agent, or Firm*—Pearne, Gordon, Sessions, McCoy, Granger & Tilberry

[57] ABSTRACT

A method of making a bimetal electrode for spark plugs on a single progressive header starts with a cylindrical bimetal blank having a diameter substantially equal to that of the finished electrode, with a core of high temperature-resistant metal and an outer layer of highly thermally conductive material, with the outer layer comprising substantially one-third of the material of the blank. In progressive operations, the blank is coned and then headed to a diameter so that the core at the headed portion has a diameter greater than that of the blank. A shearing operation then shears the outer portion of the headed portion and the thermally conductive material away to leave an end for the firing tip having a diameter equal to that of the rest of the blank but consisting essentially of the temperature-resistant core material.

15 Claims, 9 Drawing Figures

METHOD OF MAKING COPPER-CLAD BIMETAL ELECTRODES FOR SPARK PLUGS

BACKGROUND OF THE INVENTION

This invention relates generally to bimetal electrodes for spark plugs, and more particularly to bimetal electrodes for spark plugs which utilize a heat resisting metal for the core and exposed tip portion and a highly thermally conductive material for an outer layer away from the tip and to novel and improved methods and apparatus for producing such electrodes.

Because of the greatly lengthened service periods for modern spark ignition engines, efforts have been made to increase the life of spark plugs, particularly to minimize the erosion of the electrodes, which tends to increase the spark gap of the plug. The greatest problem of spark plug erosion occurs at the central electrode as it projects from the insulator toward the other electrode which is welded to the shell. These central electrodes have been made from relatively pure nickel materials because of the high temperature properties of nickel and its resistance to any chemical reaction during the combustion process. It has been recognized that one of the causes for erosion is the fact that the tip of the central electrode reaches a very high temperature, in part because of the relatively poor thermal conductivity of metallic nickel. In addition to metallic nickel, efforts have been made to use certain nickel alloys, such as Inconel, which is an alloy of nickel with chromium and a small amount of iron, because of the improved temperature resistance of such alloys. However, such efforts have not produced substantially longer electrode life because such alloys tend to have an even lower coefficient of thermal conductivity than nickel itself, so that they may operate at even higher temperatures than a pure nickel electrode.

It has been recognized that a way to reduce the temperature of the center spark plug electrode is to utilize a metal having a high degree of thermal conductivity in combination with the nickel to improve heat transfer away from the firing tip. However, there are limitations in the way this may be done because of the physical structure of the spark plugs. Because the plug is exposed to high pressures as well as temperatures within the combustion chamber, it has been found necessary to ensure that the center electrode be a single unitary piece extending from the firing tip through the ceramic insulator to an external portion, where it is generally anchored in place. Thus, the physical considerations of the spark plug structure have mandated the shape of the central electrode.

It has also been recognized that the best material for providing high thermal conductivity is metallic copper of a high degree of purity, and while such a copper material may have a coefficient of thermal conductivity more than ten times that of certain nickel alloys used in the electrode structure, the copper has a much lower melting point and is chemically much more active, so that if exposed to the high temperatures and other conditions in the combustion chamber, any pure copper would rapidly erode and corrode to the point that it would be inefficient as a heat transfer medium. For this reason, it has long been proposed to provide an electrode structure in which nickel or a nickel alloy forms the exposed portion of the electrode, while copper is provided as an inner core, preferably extending as close as possible to the firing tip and extending backward continuously to the terminal end of the plug. However, there are many problems in fabricating such a bimetallic electrode, since this generally requires the making of a cup formed of the outer material into which must be assembled a copper slug and a resultant combination then extruded or drawn to the smaller diameter of the finished electrode without permitting the formation of any voids within the electrode, which would eliminate the effectiveness of the copper as a thermal conductor. Furthermore, such methods are quite expensive because they require several stages of operation on different machines, with necessary transfers between them, and the higher cost of manufacture is an undesirable detriment to the commercial use of spark plugs having such electrodes.

It has also been recognized that a center electrode could be used in which copper was an outer layer over a nickel or nickel alloy core so long as only the core was exposed at and near the firing tip. As long as the outer layer of copper is protected by the ceramic insulator and only the nickel or core material extends outward from the insulator to form the firing tip, the copper is suitably protected so that it will not erode or corrode during normal engine operation. However, since the physical construction of the spark plug requires that the electrode have a uniform diameter both within the ceramic insulator and at the exposed firing tip, the manufacture of such electrodes in a simple and low-cost process has not heretofore been possible.

SUMMARY OF THE INVENTION

The present invention provides a method for the production of bimetal center electrodes for spark plugs having a nickel or nickel alloy core and firing tip and having a high thermally conducting copper layer over the outer periphery from a point adjacent but spaced away from the firing tip end extending continuously to the terminal end of the electrode.

According to the preferred embodiment of the invention, the electrodes are formed from a bimetal wire having an outside diameter substantially the same as that of the finished electrode. The wire comprises a central core of nickel or nickel-based alloy, together with a relatively thick cover of uniform thickness of highly thermally conductive copper of such a thickness that the copper constitutes preferably about one-third of the total amount of metal of the wire.

The electrodes are completely formed on a five-station progressive header with cut-off. The wire is fed to the cut-off, which severs blanks substantially the same diameter as the major portion of the finished electrode but of somewhat greater length. These cut-off blanks are transferred to the first station, where a coning operation is performed on the one end of the blank. At the second station, the coned portion is further upset to produce an enlarged diameter head of such diameter and thickness that the thickness or length corresponds generally to the length of the exposed portion of the electrode in the spark plug and has such a diameter that the nickel or nickel-based core material has a diameter somewhat greater than the outside diameter of the remainder of the blank, which remains at substantially the same diameter as the original wire blank. Thus, at the second station, all of the copper in the upset head has been displaced radially outward to the outer periphery of the head.

At the third or trimming station, the outer copper portion of the headed blank is trimmed away in a two-stage operation. The shank portion of the blank, which remains substantially unworked and has substantially the same diameter as that of the original wire, is held in a supporting die and struck with a punch having an axial bore therethrough equal to the finished diameter of the firing tip portion and substantially the same diameter as the rest of the blank. The punch has a generally broad, conical portion which tends to act as a shear to strip off the outer portion of the head and press it flat against the die face to form a washer-like collar consisting largely of copper material with a small amount of core material toward the center. After this washer has been substantially formed by the punch, a rod in the bore is advanced forward to engage the tip, from which all copper has now been removed, and force it inward through the die to shear off the washer-shaped collar or flange. As the punch retracts, the sheared washer can drop free, and a suitable knockout rod can push the blank out of the die, to be received by transfer fingers. Between this third and fourth stage, a transfer turns the blank end-for-end so that the firing tip portion now is fed into the die at the fourth and fifth stations, which allows suitable working by punches and dies to form the terminal end of the electrode as required by the spark plug construction. As the electrode leaves the fifth station, it is a finished electrode with a headed portion adjacent the terminal, and a copper layer extends from this headed portion toward the firing tip, so that along this portion the electrode in cross section is substantially similar to that of the original wire. At the firing tip portion, where the head was formed at the second station, the copper layer terminates and the tip portion then comprises only the core material, but having an outer diameter the same as the rest of the body of the electrode. The result is a finished center electrode for a spark plug which may then be assembled with the remaining components of the plug.

DETAILED DESCRIPTION OF THE PREFERRED EMBODIMENTS

Figure 1:
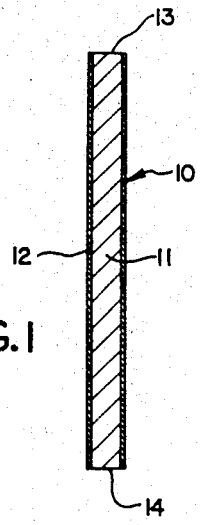
FIG. 1 is a longitudinal, cross-sectional view of the bimetal wire blank.

Referring to the drawings in greater detail, FIG. 1 shows a blank for a spark plug center electrode as sheared from a continuous coil of round wire stock at the cut-off station of a five-station progressive header. The blank 10 has a circular central core 11 of a suitable high temperature-resistant metal, such as nickel or Inconel, which is an alloy of nickel, chromium, and iron. Extending over the core 11, and intimately secured thereto, is an outer layer 12 of a highly thermally conductive metal such as pure copper. As shown, the blank is sheared to have a top end 13 and a bottom end indicated at 14, both of which will not be exactly square because of the shearing action.

Figure 7:
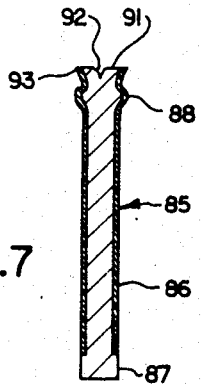
FIG. 7 is a longitudinal, cross-sectional view through the electrode after the finishing operation at the fifth station.

The material for the blank 10 is chosen to have an overall outer diameter substantially equal to that of the finished spark plug electrode. Furthermore, the copper layer is of such a thickness that the amount of copper constitutes 30% to 60%, and preferably about 40%, of the total volume of the wire stock. In a typical example, the blank 10 will have an overall outer diameter over the copper layer of about 0.098 inch, and the copper layer has a thickness of 0.009 inch or more, so that the copper constitutes over one-third of the total volume of metal of the wire, while the nickel core is the remaining portion by volume. It can also be noted that in the specific embodiment herein, the blank 10 as shown in FIG. 1 will have an initial overall length of 1.12 inches, while the finished blank as shown in FIG. 7 will have an overall length of 0.855 inch and a diameter of approximately 0.100 inch.

Figure 2:
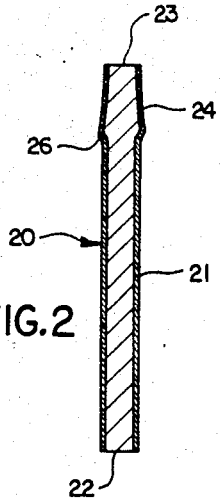
FIG. 2 is a longitudinal, cross-sectional view of the blank after the coning operation at the first station.

After the blank 10 has been cut off from the wire supply, it is transferred to the first station of the progressively header, where a conventional coning action is performed on the top end of the blank. During this coning action, in which the shank of the blank is supported in a die and a suitable coning punch strikes the end, the blank 20 as shown in FIG. 2 will retain a cylindrical shank 21, which, because of the compression and die clearances, will have increased in diameter perhaps 0.001 to 0.002 inch and the bottom end 22 will be squared off by contact with a knockout rod. At the top end 23, the material is formed into a conical portion 24 which flares outwardly and downwardly to terminate in a shoulder 26 adjacent the face of the supporting die.

Figure 3:
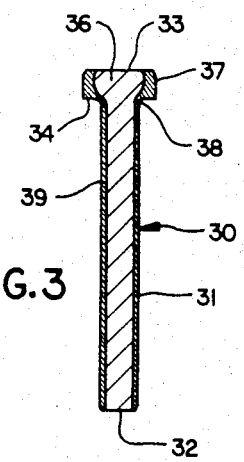
FIG. 3 is a longitudinal, cross-sectional view of the blank after the heading operation at the second station.

After the blank has been ejected from the first station, it is transferred to a second station, where a heading operation is performed by a suitable heading punch with the shank of the blank held in a conventional die. After the heading operation, the blank 30 as shown in FIG. 3 has a configuration with a cylindrical shank 31 extending upwardly from the bottom end 32 to the headed portion. The head includes an enlarged, flat top surface 33 extending in a plane normal to the axis of the blank and a parallel, annular bottom surface 34 spaced apart by the thickness of the head which is preferably substantially less than the diameter of the shank. As a result of this heading operation, a core portion 36 is expanded substantially in diameter, as the overall length of the blank has been decreased, until substantially all of the core between the top and bottom surfaces 33 and 34 has a diameter greater than the outer periphery of the cylindrical shank 31.

Extending outwardly in annular fashion around the core portion is an annular ring of copper 37 which is connected through a reduced diameter circular neck 38 to the copper layer 39 on the cylindrical shank 31.

The effect of the coning and heading operations described above is to produce an end portion or tip that will become the firing tip of the electrode in which the copper can be removed to leave the core material of nickel the only metal at the firing tip area. By virtue of the coning and subsequent heading operations, it will be seen that all of the copper in the headed portion has been moved radially outward beyond the diameter of the cylindrical shank so that a suitable trimming action can be used to remove the copper material, and this trimming operation is performed at the third station of the progressive header.

Figure 4:
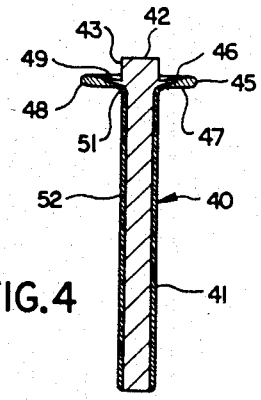
FIG. 4 is a longitudinal, cross-sectional view through the blank at the third station before the flange is sheared from the blank.

At the third station, the trimming operation takes place in two stages. The first of these is a combination shearing and heading operation, and after the first stage, the blank appears as shown in FIG. 4, in which the copper material is forced radially outward into a washer-like flange, and in the second stage at the third station, the flange is then sheared from the remainder of the electrode to produce the blank shown in FIG. 5. As shown in FIG. 4, when the blank 40 has been formed in the first stage of the operation, the blank retains a cylindrical shank 41, and is now formed with a top end 42 having a cylindrical side surface 43 formed entirely of the core material and having the same diameter as that of the cylindrical shank 41. Below the end 42 is a radially extending washer-like flange 45 having a slightly conical upper surface 46 and a radially extending lower surface 47. The flange 45 on its underside and outer portions is comprised of the copper material 48 in the outer layer, while the central portion of the upper surface includes some of the core material, as indicated at 49. Thus, the flange 45 at the lower surface 47 has a neck 51 of copper joining with the cylindrical shank 41, which is coextensive with the outer layer 52 of copper in the cylindrical shank 41.

Figure 8:
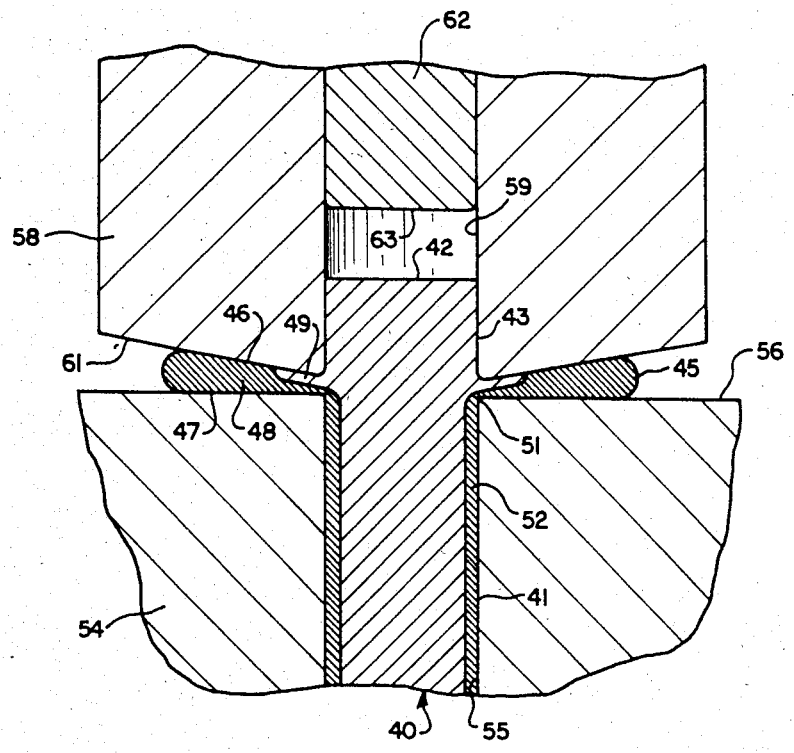
FIG. 8 is an enlarged, fragmentary, cross-sectional view showing the tooling for forming the blank at the third station, as shown in FIG. 4.

The method of forming the blank at the first stage as shown in FIG. 4 is shown in greater detail in FIG. 8. As shown therein, there is a die 54 having a cylindrical bore 55 extending axially therein and having a radially extending outer face 56. The bore 55 is sized to snugly receive the cylindrical shank 41 and the blank is pushed into the die from the transfer fingers by an outer punch 58 carried on the header slide. The punch 58 has an axial bore 59 substantially the same diameter as the die bore 55 and has a conical end face 61 for engaging the head of the blank. Mounted within the punch bore 59 is an inner punch 62 having a squared end face 63, and the inner punch 62 is movable independently of the outer punch 58 so that the inner punch 62 is recessed within the outer punch 58 until the outer punch reaches the end of its stroke.

As can be seen in FIG. 8, the effect of the conical end face 61 on the punch 58 is to leave the central portion of the core unchanged while compressing the outer part of the head which projects radially beyond the cylindrical shank. Thus, the face 61 forms the shape of the washer-like flange 45 as the punch 58 reaches the end of its stroke. The end face 61 is made conical to provide adequate clearance space for the outer portion of the flange 45 containing the copper material, while forming the inner portion of the flange 45 with the minimum thickness for easy shearing in the second stage of operation at this station.

Figure 5:
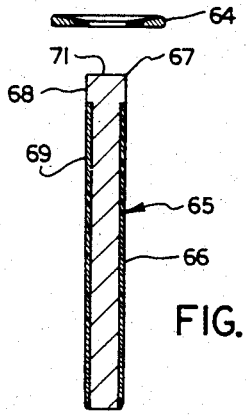
FIG. 5 is a view similar to FIG. 4 after the flange has been sheared.
Figure 9:
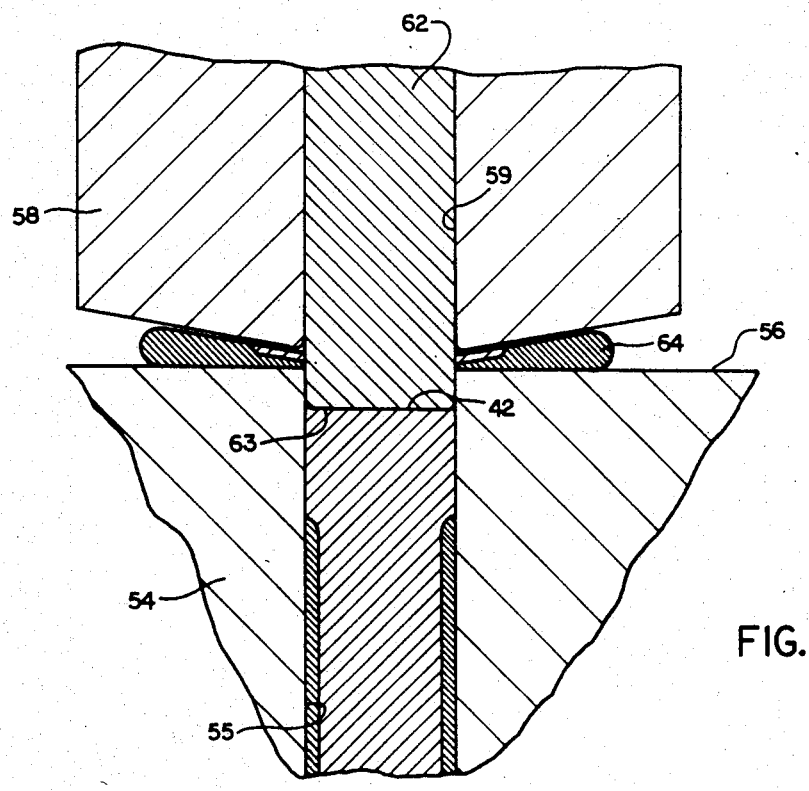
FIG. 9 is an enlarged, fragmentary, cross-sectional view similar to FIG. 8 after the flange has been sheared from the blank.

The second stage at the third station transforms the blank of FIG. 4 into that of FIG. 5, as shown in detail in FIG. 9. After the flange 45 has been fully formed at the end of the stroke of the punch 58, the inner punch 62 advances rapidly even as the outer punch 58 begins to retract, so that the punch end face 63 engages the blank top end face 42 and forces the blank inward within the bore 55 in the die 54. Since the flange 45 is restrained by the die end face 56, this necessarily produces a shearing action along the surface of the blank at the neck 51, and as shown in FIG. 9, the inner punch 62 advances until it begins to enter the die bore 55 so that the flange 45, which is now the sheared washer 64, is carried on the sidewalls of the inner punch 62. As the outer punch 58 and inner punch 62 retract away from the die 54, the inner punch 62 is retracted within the bore 59 to allow the sheared washer 64 to fall off and be recovered as scrap. As this is happening, a suitable knockout rod (not shown) then forces the blank out of the die bore 55, to be picked up by the transfer fingers for transfer to the next, or fourth, station of the progressive header.

As it leaves the third station, the electrode has the form of the blank 65 shown in FIG. 5, with the sheared washer 64 removed. The blank 65 retains a cylindrical shank 66 of substantially the same diameter as at the previous stations, but now has a tip portion 67 which consists entirely of the nickel or nickel alloy core material and has a cylindrical outer surface 68 which is the same diameter as that of the outer surface of the remainder of the cylindrical shank 66 covered by the copper layer indicated at 69. The distance between the end face 71 and the juncture between the outer surface 68 and the copper layer 69 is preferably of a length less than the diameter of the outer surface 68, but sufficiently long that when the finished electrode is assembled in a spark plug, only the tip portion 67 will project beyond the insulator and the copper layer 69 will be completely covered by the insulator.

The transfer between the third and fourth stations, unlike the other transfers, is an inverting transfer which turns the blank 180 degrees, so that at the fourth station, the exposed tip enters the die first to allow the punches at that station to work on the other end of the blank.

Figure 6:
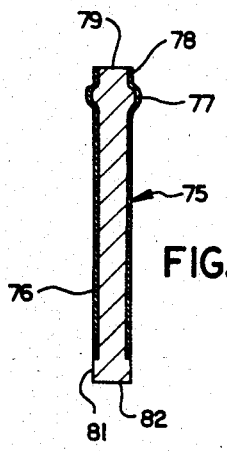
FIG. 6 is a longitudinal, cross-sectional view of the electrode after the upsetting operation at the fourth station.

The fourth station produces the blank 75, as shown in FIG. 6, and at this station, the tip end is confined by the knockout rod as the punch engages the exposed end of the blank not ony to support the blank and allow the forming operation to take place at the outer end, but also to supply pressure on the shank to smooth out any irregularities in the surface left by the shearing action at the previous station. The forming, which is done by conventional tools on the terminal end of the blank, leaves the blank 75 with a cylindrical shank portion 76, and near the end of the blank there is formed an annular flange 77 above which is a neck 78 which may be the same diameter as that of the cylindrical shank 76 and having an upper end face 79 where both the core material and the copper outer layer are exposed. At the tip portion 81, the end face 82 has now been smoothed out and formed into a smooth, flat face for the firing surface of the electrode.

After the forming operation at the fourth station, the blank is transferred without inverting to the fifth station, where the final finishing operations are performed.

The fifth station produces the finished blank 85, again having a cylindrical shank 86 which has been substantially unchanged in diameter from that of the original blank 10 as cut off from the continuous wire feed. The firing tip 87 remains unchanged at the fifth station, since it was completely formed at the previous station. At the fifth station, the blank is supported by the annular flange 88, and the top end 91 worked by a tool to form transverse grooves 92 at right angles on the end of the blank, forcing the material outwards so that the copper jacket has a flared edge 93. This forming of the terminal end of the electrode is for purposes of connecting the electrode to the terminal structure in the spark plug, and it will be understood that the forming operations at the fourth and fifth stations are by way of example only and other terminal end structures could be formed as desired, since the structure at this end of the blank forms no part of the present invention.

It can therefore be seen that the present invention is a method of making a bimetal electrode of a high temperature-resistance material suitable for the spark gap surface, together with a highly thermally conductive material for dissipating heat from the firing tip of the electrode back into the remainder of the spark plug structure. Using a wire formed with the material of the firing tip in the core, and having an outer layer of thermally conductive material, the electrode can be completely formed in a five-station progressive header with a minimum working of the material. The basic diameter of the wire which forms the cylindrical shank of the electrode is not changed substantially in diameter at any stage in the operation. By means of the coning, heading, and trimming steps at the first three stations, the thermally conductive layer at the firing tip is removed and a firing tip of the same diameter as the rest of the electrode is formed entirely from the core material. The remaining operations at stations 4 and 5 are conventional forming operations for forming the terminal end of the plug as required by the specific construction of the spark plug.

Although the preferred embodiment of this invention has been shown and described, it should be understood that various modifications and rearrangements of parts may be resorted to without departing from the scope of the invention as claimed herein.

What is claimed is:

1. A method of making a bimetal electrode for a spark plug comprising preparing a cut length of wire having a circular cross-section with a core selected from one metal and a substantially uniform outer layer of a second metal and wherein said core and outer layer have a substantially uniform cross-section throughout said length of wire with the core being exposed at both its ends, axially compressing said wire to form a radially enlarged head on one end of said wire to a degree such that the core at said head is radially expanded to a diameter at least as great as the outside diameter of essentially unexpanded portions of said wire, trimming the radially projecting part of said head with an axial shear force to leave a blank of uniform diameter with a portion of said headed one end consisting essentially entirely of said one metal the core being formed of a metal which is relatively heat resisting and the outer layer is formed of a metal which is relatively highly thermally conductive.

2. A method of making a bimetal electrode as set forth in claim 1, wherein said second metal in said wire is at least 20% by weight of the total metal in said wire.

3. A method of making a bimetal electrode as set forth in claim 2, wherein said one metal is highly temperature-resistant and said second metal is highly thermally conductive.

4. A method of making a bimetal electrode as set forth in claim 3, wherein said one metal is at least predominantly nickel and said second metal is copper.

5. A method of making a bimetal electrode as set forth in claim 1, wherein after trimming said headed end said portion consisting essentially of said one metal has an axial length less than the diameter of said blank.

6. A method of making a bimetal electrode as set forth in claim 1, wherein said cut length of wire has a diameter substantially equal to the diameter of the finished electrode.

7. A method of making a bimetal electrode for a spark plug on a progressive header, comprising preparing a cylindrical bimetal blank of uniform circular cross section having a core of heat resisting metal and an outer layer of highly thermally conductive metal, forming an enlarged head on one end of said blank at one station of said header, said core at said head having a diameter greater than the diameter of said blank, transferring said headed blank to another station of said header, supporting said headed blank in a die with said head on the face of said die, impacting said head with a first punch having a bore with a diameter equal to that of said blank to deform the radially outer portion of said head into a thin washer portion, and thereafter shearing said washer portion from said blank.

8. A method of making a bimetal electrode as set forth in claim 7, wherein said enlarged head has an axial thickness less than the diameter of said blank.

9. A method of making a bimetal electrode as set forth in claim 7, wherein said shearing is done by an inner punch in the bore of said first punch pushing said blank into said die.

10. A method of making a bimetal electrode as set forth in claim 7, wherein said washer portion has a lesser thickness adjacent said blank than at the radially outer edge thereof.

11. A method of making a bimetal electrode as set forth in claim 7, wherein said outer layer has a thickness of about 9% of the diameter of the blank.

12. A method of making a bimetal electrode as set forth in claim 7, wherein said cylindrical bimetal blank has a diameter substantially equal to that of the finished electrode.

13. A method of making a bimetal electrode as set forth in claim 7, including the subsequent step of transferring the blank to another station of said header while turning it end-for-end and thereafter performing another heading operation on the opposite end of the blank from that on which said first heading operation was performed.

14. A method as set forth in claim 1, wherein said trimming operation is conducted in two stages, in a first of said stages diametrally sizing the head with a punch driven in a direction from said one end towards the opposite end, in a second of said stages axially shearing the radially projecting part from the remaining portion of the one end.

15. A method as set forth in claim 14, wherein the radially projecting part formed by said sizing step is thereafter sheared by driving it in a direction away from said opposite end.

* * * * *